US009808689B1

(12) United States Patent
Siepmann

(10) Patent No.: US 9,808,689 B1
(45) Date of Patent: Nov. 7, 2017

(54) TIERED BEVERAGE PONG GAME SYSTEM

(71) Applicant: Scott Siepmann, Scottsdale, AZ (US)

(72) Inventor: Scott Siepmann, Scottsdale, AZ (US)

( * ) Notice: Subject to any disclaimer, the term of this patent is extended or adjusted under 35 U.S.C. 154(b) by 0 days.

(21) Appl. No.: 15/147,840

(22) Filed: May 5, 2016

(51) Int. Cl.

| | |
|---|---|
| ***A63B 63/00*** | (2006.01) |
| ***A63B 67/00*** | (2006.01) |
| ***A47G 19/22*** | (2006.01) |
| ***A63B 63/08*** | (2006.01) |
| ***A63B 67/06*** | (2006.01) |
| ***A63F 7/00*** | (2006.01) |
| *A63F 3/00* | (2006.01) |

(52) U.S. Cl.
CPC ..... *A63B 67/002* (2013.01); *A47G 19/2205* (2013.01); *A63B 63/08* (2013.01); *A63B 67/06* (2013.01); *A63F 7/00* (2013.01); *A63B 63/00* (2013.01); *A63F 3/00214* (2013.01); *A63F 2250/024* (2013.01)

(58) Field of Classification Search
CPC ..... A63F 3/00214; A63F 2250/024; A63B 67/06; A63B 67/002; A63B 67/007
USPC ..... 273/398–402, 241, 261, 282.1, 282.3
See application file for complete search history.

(56) References Cited

U.S. PATENT DOCUMENTS 4,082,283 A * 4/1978 La Ferla ..... A63F 3/00214 273/153 J
4,179,127 A * 12/1979 Goodman ..... A63F 3/00214 273/241
4,744,566 A * 5/1988 Malavazos ..... A63F 7/305 273/138.4
5,004,245 A * 4/1991 Schumacher ..... A63F 3/0023 273/241
5,660,388 A * 8/1997 Benn ..... A63F 3/00214 273/241
5,662,329 A * 9/1997 Nason ..... A63F 3/00214 273/261
5,833,240 A * 11/1998 Barbour ..... A63F 3/00574 273/282.1
6,279,907 B1 * 8/2001 Hullinger ..... A63F 3/00214 273/241
6,581,933 B1 * 6/2003 Zivan ..... A63F 3/00214 273/148 A
8,353,515 B2 * 1/2013 Cheng ..... A63F 3/00214 273/241

(Continued)

*Primary Examiner* — Mark Graham
(74) *Attorney, Agent, or Firm* — Michelle L. Gross, P.C.

(57) ABSTRACT

A tiered beverage pong game system comprising a plurality of tiered platforms, each having at least one of a width and a length that is greater than any higher tiered platform and a plurality of beverage container placement markers located on the tiered platforms, each configured to seat a beverage container thereon, the beverage container placement markers comprising a plurality of colors indicating which direction a beverage container seated on beverage container placement marker is passed when a player bounces a ball into the corresponding beverage container. A top tiered platform comprises a single beverage container placement marker and each tiered platform comprises a greater number of beverage container placement markers than any higher tiered platform. Each side of each tiered platform comprises a different color along a vertical or horizontal side that corresponds with a color among the plurality of colors of the beverage container placement markers.

18 Claims, 7 Drawing Sheets

(56) References Cited

U.S. PATENT DOCUMENTS

| | | | | |
|---|---|---|---|---|
| 8,651,492 | B1 * | 2/2014 | Cappuccio | A63B 67/002 273/317 |
| 2004/0135314 | A1 * | 7/2004 | Peterson | A63F 3/00176 273/241 |
| 2007/0187893 | A1 * | 8/2007 | Brown | A63F 3/00094 273/241 |
| 2009/0230625 | A1 * | 9/2009 | Clutterbuck | A63F 3/02 273/287 |
| 2010/0044964 | A1 * | 2/2010 | Constantine | A63B 63/08 273/378 |
| 2012/0169012 | A1 * | 7/2012 | Parker | A63B 67/002 273/400 |
| 2015/0069708 | A1 * | 3/2015 | Mashburn | A63B 67/06 273/400 |
| 2016/0038809 | A1 * | 2/2016 | Rockwell | A63B 67/06 273/401 |

* cited by examiner

TIERED BEVERAGE PONG GAME SYSTEM

BACKGROUND

1. Technical Field

Aspects of this document relate generally to beverage consumption games for entertainment purposes.

2. Background Art

Any discussion of the related art throughout the specification should in no way be considered as an admission that such related art is widely known or forms part of common general knowledge in the field.

Beer pong, also known as Beirut, is a popular party game, particularly on college campuses. While the rules of the game may vary slightly, generally there are two teams of players at opposite sides of a table with a plurality of cups arranged in a formation similar to that of bowling pins at a bowling alley. The players take turns tossing or bouncing a ping pong ball with the object of having the ball land into a cup at their opponents' end of the table at which time, the opponent must consume the beverage, which is typically beer or another alcoholic beverage.

SUMMARY

Implementations of a tiered beverage pong game system may comprise a plurality of tiered platforms, each tiered platform having at least one of a width and a length that is greater than any higher tiered platform and a plurality of beverage container placement markers located on the tiered platforms, each beverage container placement marker configured to seat a beverage container thereon, the beverage container placement markers comprising a plurality of colors indicating which direction a beverage container seated within the beverage container placement marker is passed when a player bounces a ball into the corresponding beverage container seated on the beverage container placement marker, wherein a top tiered platform comprises a single beverage container placement marker and each tiered platform comprises a greater number of beverage container placement markers than any higher tiered platform and wherein each side of each tiered platform comprises a different color along at least one of a vertical side wall and a horizontal side wall of the tiered platform that corresponds with a color among the plurality of colors of the beverage container placement markers.

Embodiments may comprise one or more of the following elements. Each tiered platform may comprise a quadrilateral shape. The plurality of tiered platforms may comprise four tiered platforms. The beverage container placement markers may comprise a disk having a raised edge that is configured to prevent movement of a beverage container placed therein. Each tiered platform may comprise a lesser number of beverage container placement markers on a top surface of the tiered platform than is located on the tiered platform directly below. A lowest tiered platform may comprise four beverage container placement markers on a top surface of the lowest tiered platform along each side of the quadrilateral. The second lowest tiered platform may comprise three beverage container placement markers on a top surface of the second lowest tiered platform along each side of the quadrilateral. The third lowest tiered platform may comprise two beverage container placement markers on a top surface of the third lowest tiered platform along each side of the quadrilateral. Each beverage container marker located along a first side of the quadrilateral on each tiered platform may comprise a color that is different than the color along the at least one of the vertical side wall and the horizontal side wall of the tiered platforms on the first side of the quadrilateral. The beverage container placement marker of the top tiered platform may comprise a color that is different than a color of the beverage container placement markers on any other tiered platform. On a first side of the quadrilateral of the lowest tiered platform, a leftmost beverage container marker may comprise a first color, two middle beverage container markers may comprise a second color, and a rightmost beverage container marker may comprise a third color. On the first side of the quadrilateral of the second lowest tiered platform, a leftmost beverage container marker may comprise the first color, a middle beverage container marker may comprise the second color, and a rightmost beverage container marker may comprise the third color. On the first side of the quadrilateral of the third lowest tiered platform, a leftmost beverage container marker may comprise the first color and a rightmost beverage container marker comprises the third color. The plurality of tiered platforms may be coupled to a flotation device. The plurality of tiered platforms may be configured to collapse within a center of a lowest tiered platform.

Implementations of a method of using a tiered beverage pong game system may comprise: a) bouncing, by a first player, a ball on a surface such that the ball lands in a beverage container that is located on a beverage container placement marker located on a tiered platform of the tiered beverage pong game system comprised of a plurality of tiered platforms each having at least one of a width and a length that is greater than any higher tiered platform, wherein each side of each tiered platform comprises a different color along at least one of a vertical side wall and a horizontal side wall of the tiered platform that corresponds with a color among the plurality of colors of the beverage container placement markers and a player among the a plurality of players; b) passing the beverage container to a second player from among the plurality of players, the second player determined based on a color of the beverage container placement marker on which the beverage container into which the ball landed is located; c) consuming, by the second player, a beverage within the beverage container and removing the beverage container from the tiered platform; and repeating steps a through c by each player in turn until one player clears a single beverage container located on a single beverage container marker on a top tiered platform and all beverage containers from the one player's side of the tiered platforms having the color along the at least one of the vertical side wall and the horizontal side wall of the tiered platforms associated with the one player.

Embodiments may comprise one or more of the following elements. The first player may pass the beverage container to the second player when the first player bounces the ball into a beverage container located on a side of the tiered platform associated with the first player. The method may further comprise consuming, by the first player, a beverage within a beverage container into which the ball lands when the beverage container is located on a side of the tiered platform associated with another player. The method may further comprise determining which player has a first turn by bouncing a ball by each player and awarding the first turn to the player whose ball landed within a beverage container on a tiered platform higher than that of any other player. The beverage pong game system may comprise four quadrilateral tiered platforms and a lowest tiered platform comprises sixteen beverage container markers, a second lowest tiered platform comprises twelve beverage container markers, and a third lowest tiered platform comprises eight beverage container markers.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of post-AIA 35 U.S.C. §112(f). Thus, the use of the words "function," "means" or "step" in the Detailed Description, Drawings, or Claims is not intended to somehow indicate a desire to invoke the special provisions of post-AIA 35 U.S.C. §112(f), to define the invention. To the contrary, if the provisions of post-AIA 35 U.S.C. §112(f) are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of post-AIA 35 U.S.C. §112(f). Moreover, even if the provisions of post-AIA 35 U.S.C. §112(f) are invoked to define the claimed disclosure, it is intended that the disclosure not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Unless otherwise defined, all technical and scientific terms used herein have the same meaning as commonly understood by one of ordinary skill in the art to which this invention belongs. Although methods and materials similar to or equivalent to those described herein can be used in the practice or testing of the tiered beverage pong game system, suitable methods and materials are described above. All publications, patent applications, patents, and other references mentioned herein are incorporated by reference in their entirety to the extent allowed by applicable law and regulations. The tiered beverage pong game system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. As used herein, phrases such as "make contact with," "coupled to," "touch," "interface with" and "engage" may be used interchangeably.

The features, structures, or characteristics of the invention described throughout this specification may be combined in any suitable manner in one or more embodiments. For example, the usage of the phrases "exemplary embodiments", "some embodiments" or other similar language refers to the fact that a particular feature, structure, or characteristic described in connection with the embodiment may be included in at least one embodiment of the present invention. Thus, appearances of the phrases "exemplary embodiments", "in some embodiments", "in other embodiments" or other similar language, throughout this specification do not necessarily all refer to the same group of embodiments, and the described features, structures, or characteristics may be combined in any suitable manner in one or more embodiments.

Figure 1:
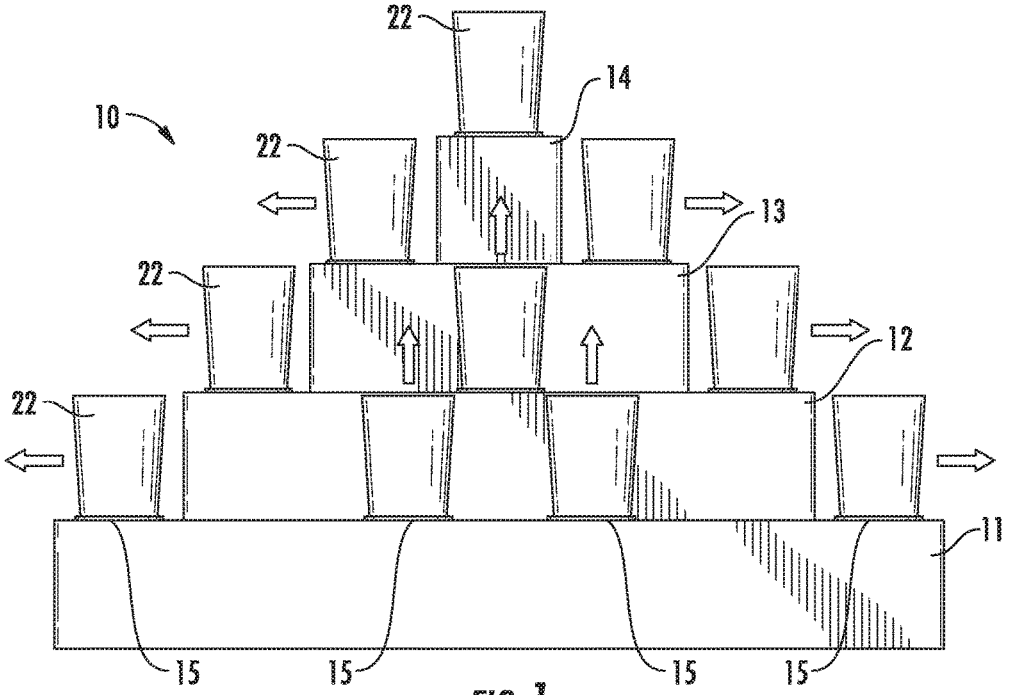
FIG. 1 provides an example of a tiered beverage pong game system indicating with arrows indicating a direction in which beverage containers are passed in accordance with an exemplary embodiment of the system.

FIG. 1 provides an exemplary depiction of a beverage pong game system having a structure of tiered platforms of decreasing size which form a quasi-pyramid shape. While it is contemplated that embodiments of the system may comprise any number of tiered platforms of any size or shape, for simplicity of illustration, an exemplary embodiment having four tiered platforms of a quadrilateral shape will be discussed as an illustrative and non-limiting example. As shown, a plurality of beverage container placement markers 15 are present on a top surface of the tiered platforms. The beverage container placement markers 15 may be flush with the top surface of the tiered platform or may comprise a disk or other recessed structure having a raised lip around the edge to facilitate proper placement and prevent tipping of a beverage container 22 when placed on or in the beverage container placement marker 15. While this disclosure is intended to cover any shape of beverage container placement marker 15, a round shape may be preferable to match the typical footprint of a standard beverage container 22 such as a cup, glass, or other drinking receptacle.

Figure 2:
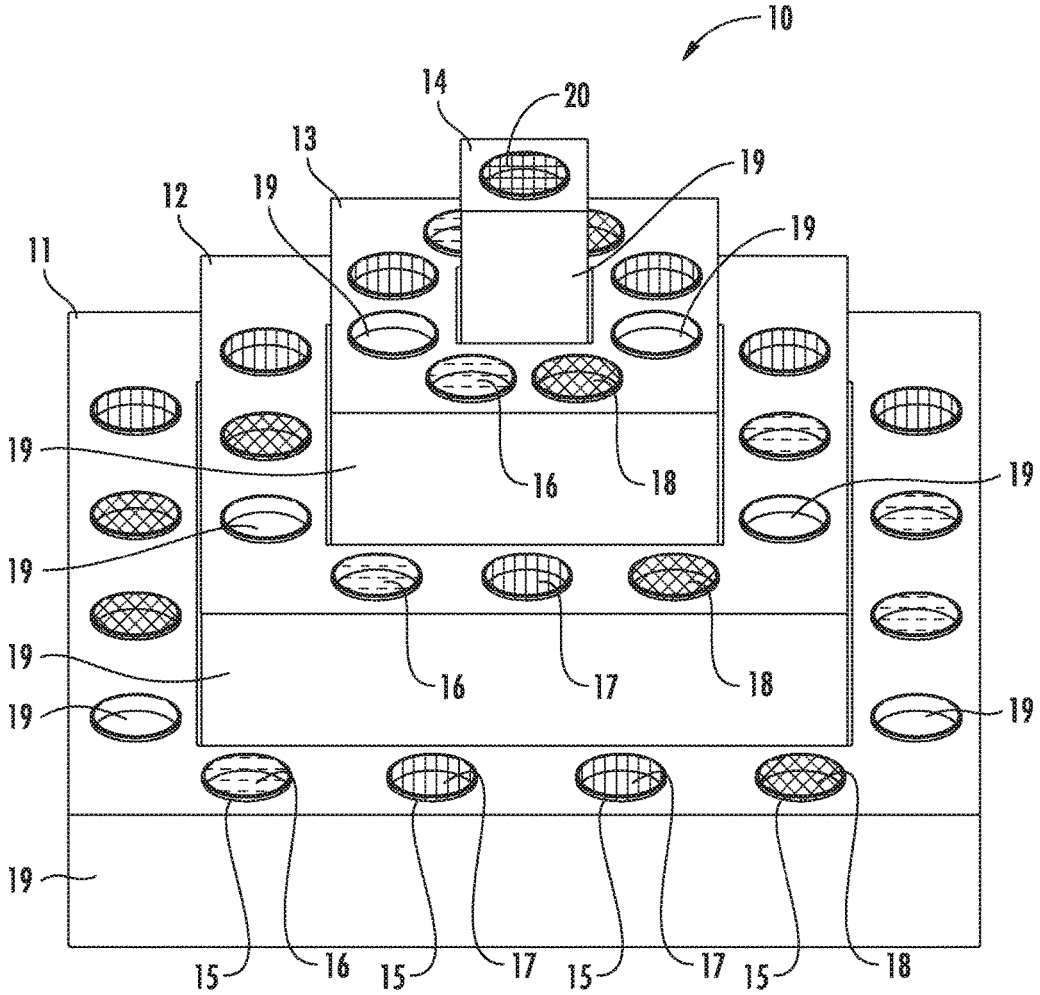
FIGS. 2-5 provide perspective views of four sides of an implementation of a beverage pong game system comprising quadrilateral tiered platforms and an exemplary color coding scheme.
Figure 3:
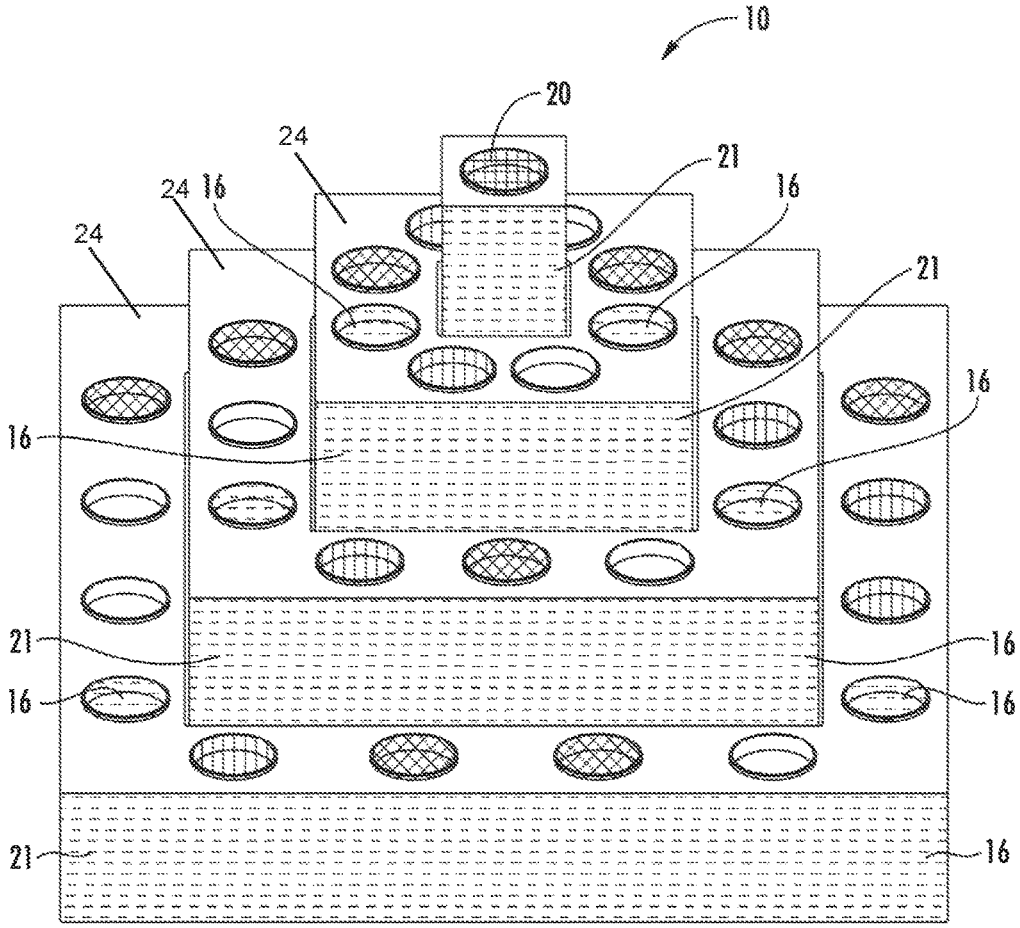
Figure 4:
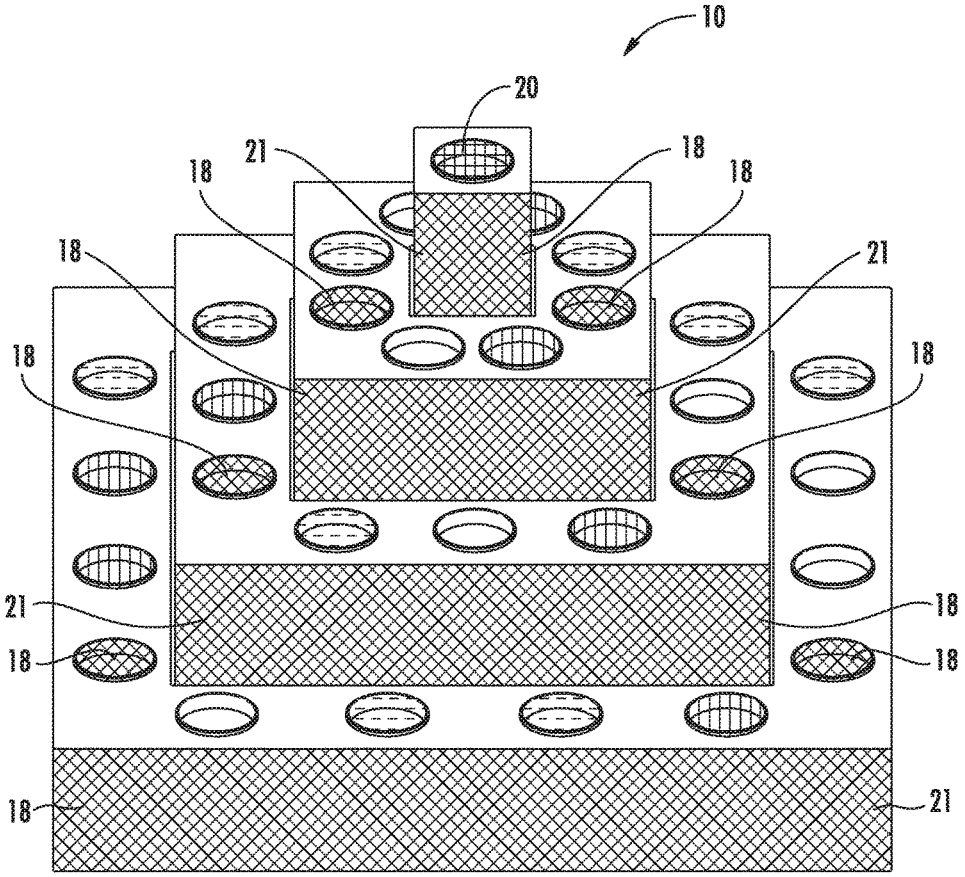
Figure 5:
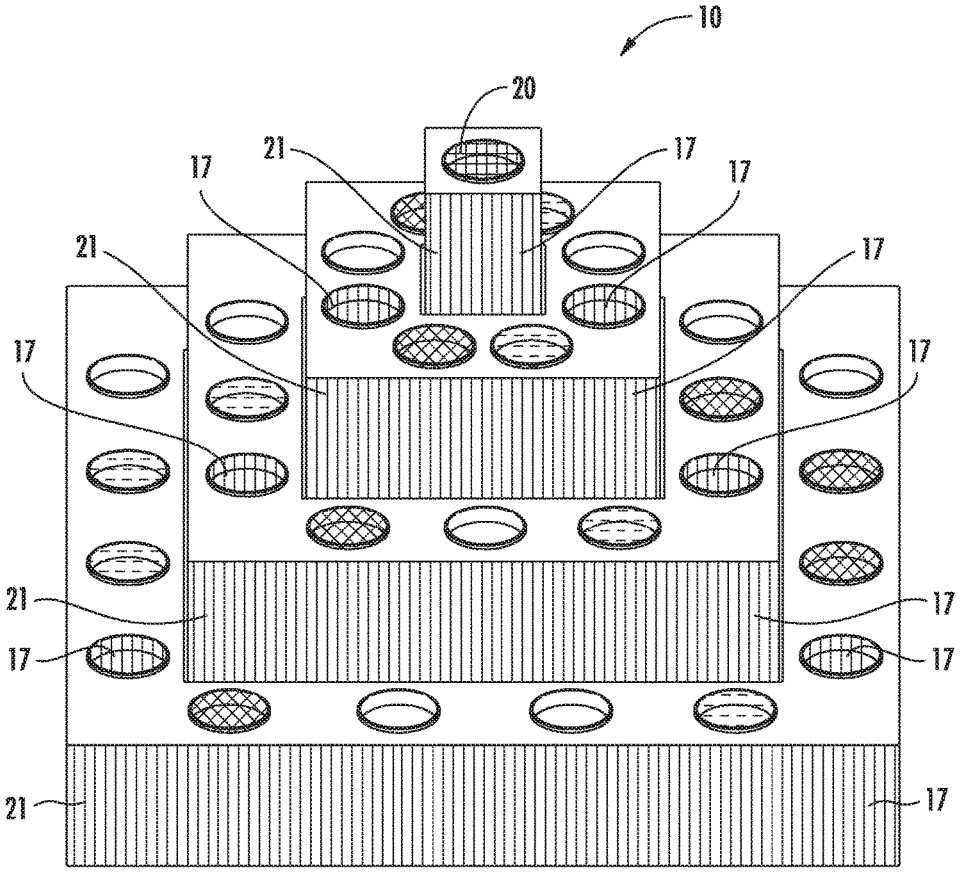

FIGS. 2-5 provide respective views of all four sides of a quadrilateral tiered platform structure comprising an exemplary color scheme that is designed to facilitate use of the tiered beverage pong system for entertainment while engaging in a game in accordance with one or more rule sets. In some embodiments, rather than colors, symbols, teams, mascots, or other insignia that relates beverage containers placement markers 15 with a vertical side wall 21 of a tiered platform may also be used which may be interchangeable to facilitate the ability to attach beverage container placement markers 15 and vertical side wall 21 overlays to fit player interests or occasions. In this exemplary embodiment which comprises a lowest tiered platform 11, a second lowest tiered platform 12, a third lowest tiered platform 13, and a highest tiered platform 14, each tiered platform may comprise a different number of beverage container placement markers 15 in accordance with the width and length of the respective tiered platform. As shown, the leftmost beverage container placement marker 15 on the lowest tiered platform 11 comprises a first color 16. Two middle beverage container placement markers 15 on the lowest tiered platform 11 comprise a second color 17 and the rightmost beverage container placement marker 15 comprises a third color 18. Moving to higher tiers, in this embodiment, the second lowest tier 12 has a leftmost beverage container placement marker 15 comprising the first color 16, a middle beverage container placement marker 15 comprising the second color 17, and a rightmost beverage container placement marker 15 comprising the third color 18. The third lowest tiered platform 13 comprises a beverage container placement marker 15 to the left having the first color 16 and a beverage container placement marker 15 to the right having the third color 18. The colors of the beverage container placement marker 15 are used to indicate the direction in which a beverage container 22 that sits upon the beverage container placement marker 15 will be passed to another player during use of the tiered beverage pong game system 10 to play a game. A fourth color 19 is present on the vertical side wall 21 of the first side of the tiered platforms as shown in FIG. 2 and this fourth color 19 is not present among the beverage container placement markers 15 that are aligned along the first side of the tiered platform structure. The highest tiered platform 14 as shown in this embodiment comprises only a single beverage container placement marker 15 which comprises a fifth color 20. FIGS. 3-5 depict second, third, and fourth sides of the tiered platform structure respectively, each of which uses a first 16, second 17, or third 18 color on the respective vertical side walls 21 of the tiered platforms that is not found among the colors of the beverage container placement markers 15 present on the same side of the platform. In some embodiments, rather than colors, symbols, teams, mascots, or other insignia that relate beverage containers placement markers 15 with a horizontal 24 or vertical side wall 21 of a tiered platform may also be used and may be interchangeable to facilitate the ability to attach beverage container placement markers 15 and horizontal 24 or vertical side wall 21 overlays to fit player interests or occasions.

Figure 6:
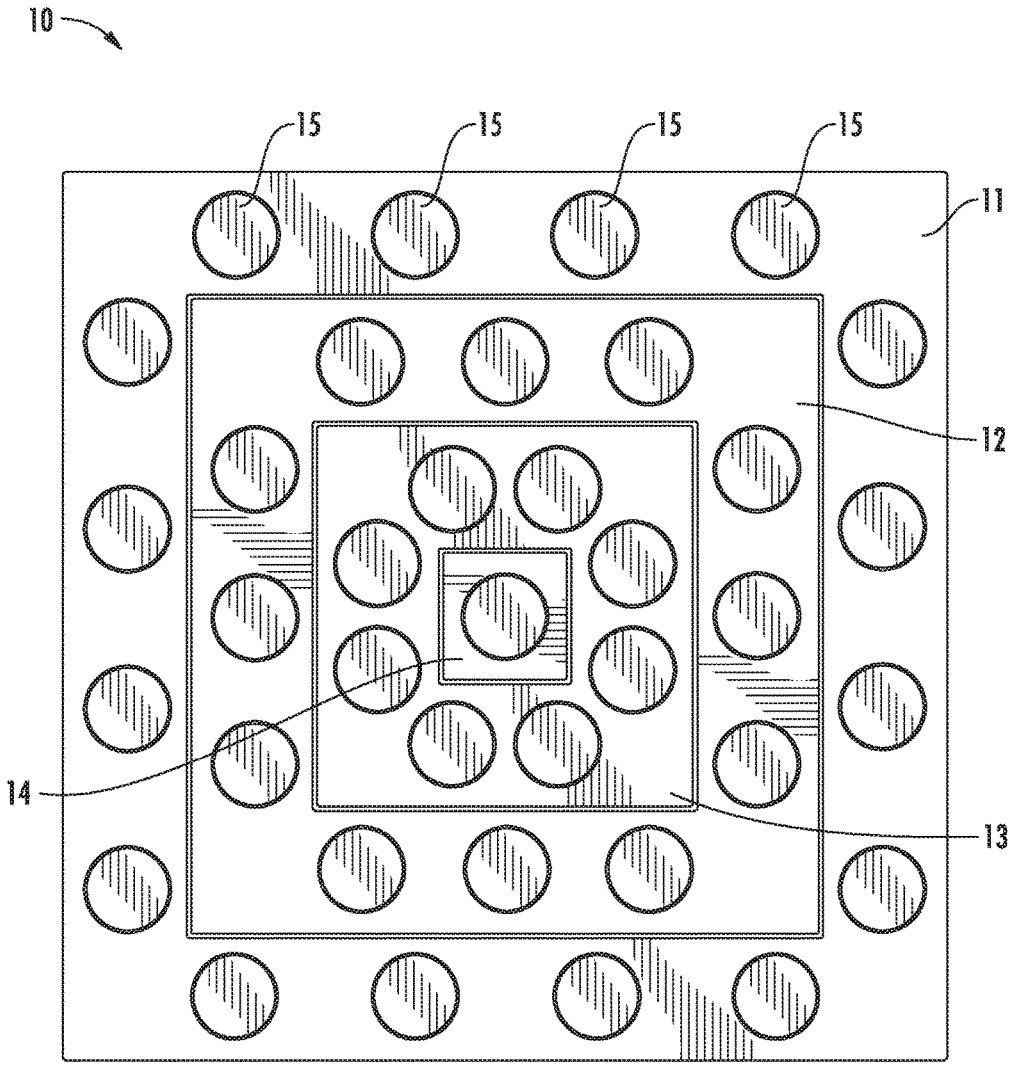
FIG. 6 provides a top view of an implementation of a beverage pong game system.
Figure 7:
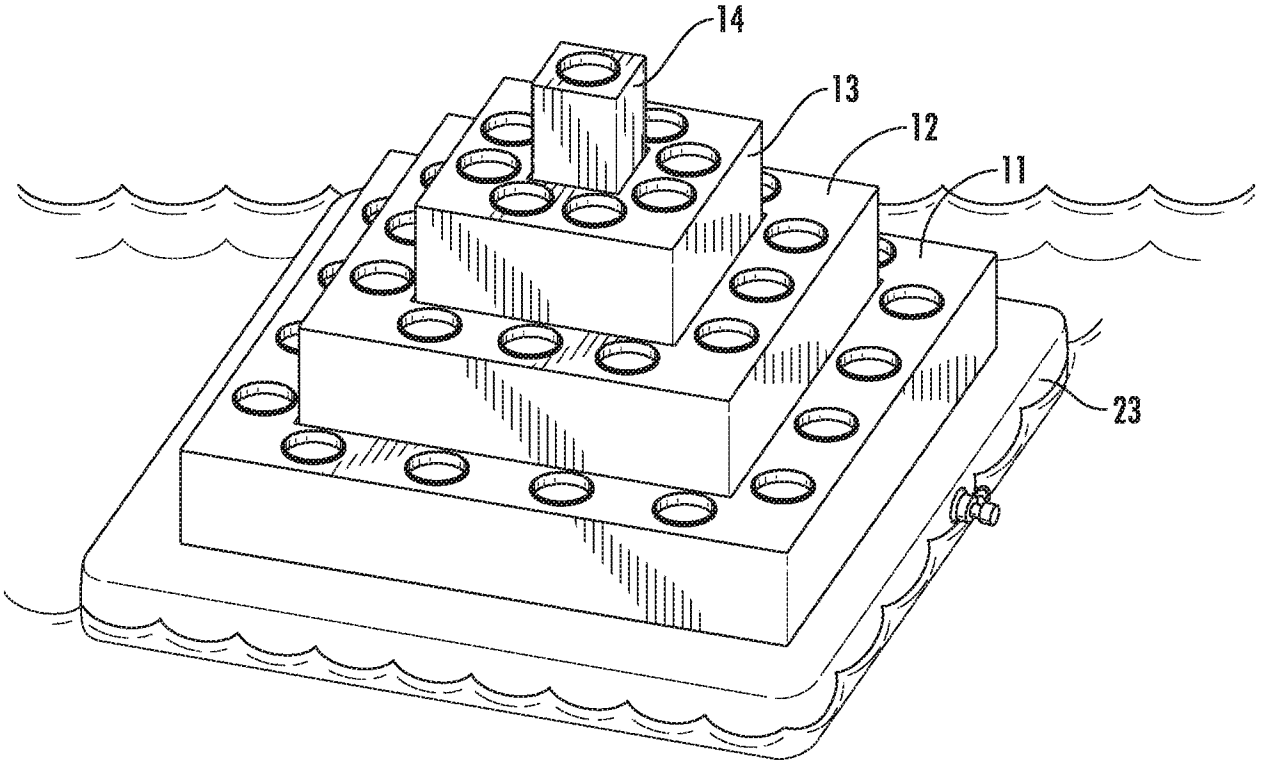
FIG. 7 provides a perspective view of an implementation of a beverage pong game system coupled to a flotation device.

FIG. 6 provides a top view of an exemplary configuration of beverage container placement markers 15 on the plurality of tiered platforms. To play a game by using the tiered beverage pong game system 10, the tiered platform structure may be placed on a table, floor, or other appropriate surface which is conducive to bounce a ping pong or other ball off of. A beverage container 22 is placed on each beverage container placement marker 15 as shown in FIG. 1 and at least partially filled with a beverage which may be alcoholic or non-alcoholic in nature. In one embodiment, the beverage containers 22 on the three lower tiered platforms 11, 12, 13 may be filled to approximately one quarter of the capacity of the beverage container 22 and the beverage container 22 on the highest tiered platform 14 may be filled to a higher level such as for example, to half of the capacity of the beverage container 22, however any appropriate fill level may be used for any of the beverage containers 22. All beverage containers 22 may contain the same type of beverage or the beverage containers 22 may contain different beverages depending upon player preferences. In accordance with one set of exemplary rules, a player or team of players is associated with each side of the quadrilateral tiered platform structure and a minimum of four players is needed to engage in use of the game system.

To determine which player will have the first turn in the game, a player associated with each side of the tiered platform structure bounces a ping pong ball or other ball of appropriate size and weight on a surface on which the tiered platform structure rests with a goal of having the ball bounce into a beverage container 22 at the highest possible platform level. Whichever player's ball lands in a beverage container 22 at a platform level higher than that at which the other players' balls landed is awarded the first turn and becomes the first player to begin the game. During this initial step to determine which player gets to take the first turn, the players may bounce their balls one at a time or all of the players may bounce their balls simultaneously in response to a chant indicting the time at which the balls are to be released such as for example "one, two, three, Kong Pong" after which the balls are released. If multiple players' balls land within a beverage container 22 on the same tiered platform, this process can be repeated until there is an individual player having a ball that has landed in a beverage container 22 at a higher platform level that that of the other players. This player becomes the first player to take a turn and bounces the ball from the surface on which the tiered platform structure rests in an attempt to land the ball into one of the beverage containers 22 on the first player's side of the tiered platform structure.

The first player bounces the ball with the goal of the ball landing in one of the beverage containers 22 on the first player's side of the tiered platform. If this is successfully accomplished, the first player passes the beverage container 22 that the ball landed in to another player in accordance with the color or other symbol associated with the beverage container placement marker 15 that the beverage container 22 is located upon. FIG. 1 depicts the direction in which the beverage containers 22 are passed according to an exemplary embodiment of the game rules. For example, the beverage containers 22 on the left side of the first player's side of the tiered platform structure may be passed to the player whose side of the tiered platform structure is to the left of the first player, the beverage containers 22 on the right side of the first player's side of the tiered platform structure may be passed to the player whose side of the tiered platform structure is to the right of the first player, and the beverage containers 22 in the middle of the first player's side of the tiered platform structure may be passed to the player whose side of the tiered platform structure is across from the first player in accordance with matching the colors, symbols, or other insignia of the beverage container placement marker 15 with the same color, symbol, or other insignia on the vertical 21 or horizontal side wall 24 of the tiered platforms to which the beverage container 22 is passed. This is merely an example and the beverage containers may be passed in any other direction that corresponds to an association between the beverage container placement markers 15 and the vertical side walls 21 of the tiered platforms on a player's side of the tiered platform structure. The player who receives the beverage container 22 from the first player then consumes the beverage therein. The beverage container is then removed from the tiered platform leaving the beverage container placement marker from which it was removed empty.

However, if the first player's ball lands in a beverage container 22 that is on another player's side of the tiered platform structure, the first player then consumes the beverage therein and removes the beverage container 22 from the tiered platform leaving the beverage container placement marker 15 from which it was removed empty. If the ball lands in the beverage container 22 located on the highest tiered platform 14, the first player then chooses which other player the beverage container 22 is passed to for consumption of the beverage.

If the first player is unsuccessful in landing the ball into a beverage container 22, the first player may try as many times as necessary to do so or may forfeit the first players turn after one or any other predetermined number of unsuccessful bounces. Play continues by repeating this process and moving in a clockwise or counterclockwise manner or by having the player who consumed the beverage be the next player to take a turn. A winner is determined when a player or team has cleared all of the beverage containers 22 from that player or team's side of the tiered platform structure and has also cleared the beverage container from the highest tiered platform 14.

In an alternative embodiment, the tiered platform structure may or may not have beverage container placement markers 15 and/or color or symbol coding associated with the vertical side walls 21 of the tiered platforms. Beverage containers 22 are placed on each tiered platform other than the highest tiered platform 14 and filled at least partially with a beverage. A determination is made using any appropriate methodology to determine which player is the first to take a turn. The first player then consumes the beverage within a beverage container 22 on the lowest tiered platform 11 and place the empty beverage container 22 back onto the lowest tiered platform with a portion of the beverage container 22 extending over the outer edge of the lowest tiered platform. The player then attempts to flip the empty beverage container 22 up onto the second lowest tiered platform 12 such that the beverage container 22 lands upside down. If the first player is unsuccessful, the beverage container 22 is returned to the lowest tiered platform 11 and play continues to the next player. If the first player is successful, the beverage container 22 is removed from the tiered platform structure and the first player consumes a beverage from a second beverage container 22 on the lowest tiered platform 11 and attempt to flip that beverage container 22 to the second lowest tiered platform 12. Anytime a beverage container 22 is successfully flipped to a higher tiered platform and lands upside down, the beverage container 22 is removed. A player continues to play as long as the player continues to successfully flip the beverage containers 22 to the next highest tiered platform. When a player's tiered platforms are cleared of all beverage containers 22 and the player is the first to successfully flip the player's last beverage container 22 to the highest tiered platform 14, that player is deemed the winner. The non-winning players then may consume the beverages in the beverage containers 22 on their respective sides of the tiered platform structure.

Alternatively, in another embodiment, all players may start simultaneously in response to reciting a chant or phrase such as by non-limiting example, "one, two, three, Flip Kong" after which all players drink the beverage from within a beverage container 22 on the lowest tiered platform 11 on the players' respective sides of the tiered platform structure and then attempt to flip the beverage container 22 to the second lowest tiered platform 12 and continue in accordance with the rules above, however, in the event of an unsuccessful flip, the player continues to attempt to flip the beverage container 22 until success is achieved after replacing the beverage container 22 on the original tiered platform on which it was positioned.

While the beverage containers 22 may be flipped in accordance with any appropriate methodology, to enhance the competitiveness of the game, flipping technique may be limited to the use of one or any other predetermined number of fingers or digits.

In some embodiments, the tiered platform structure may be collapsible and reversible so that two versions of a game having different rules may be played using the same tiered platform structure in a different configuration. In other embodiments, the tiered platform structure may be coupled to a flotation device 23 for use for aquatic entertainment.

In places where the description above refers to particular implementations a tiered beverage pong game system, it should be readily apparent that a number of modifications may be made without departing from the spirit thereof and that these implementations may be applied to other to systems and techniques for touch sensing and alternative energy sources.

What is claimed is:

1. A tiered beverage pong game system comprising:

a plurality of tiered platforms, each tiered platform comprising a quadrilateral shape having at least one of a width and a length that is greater than any higher tiered platform; and a plurality of interchangeable beverage container placement markers located on the tiered platforms, each beverage container placement marker comprising a disk having a raised lip around an edge of the beverage container placement marker that is configured to prevent movement of a beverage container placed thereon, the beverage container placement markers comprising a plurality of colors indicating which direction a beverage container seated within the beverage container placement marker is passed when a player bounces a ball into the corresponding beverage container seated on the beverage container placement marker;

wherein a top tiered platform comprises a single beverage container placement marker and each tiered platform comprises a greater number of beverage container placement markers than any higher tiered platform; and wherein each side of each tiered platform comprises a different color along at least one of a vertical side wall and a horizontal side wall of the tiered platform that corresponds with a color among the plurality of colors of the beverage container placement markers.

2. The tiered beverage pong game system of claim 1, wherein the plurality of tiered platforms comprises four tiered platforms.

3. The tiered beverage pong game system of claim 2, wherein each tiered platform comprises a lesser number of beverage container placement markers on a top surface of the tiered platform than is located on the tiered platform directly below.

4. The tiered beverage pong game system of claim 2, wherein a lowest tiered platform comprises four beverage container placement markers on a top surface of the lowest tiered platform along each side of the quadrilateral.

5. The tiered beverage pong game system of claim 4, wherein the second lowest tiered platform comprises three beverage container placement markers on a top surface of the second lowest tiered platform along each side of the quadrilateral.

6. The tiered beverage pong game system of claim 5, wherein the third lowest tiered platform comprises two beverage container placement markers on a top surface of the third lowest tiered platform along each side of the quadrilateral.

7. The tiered beverage pong game system of claim 1, wherein each beverage container marker located along a first side of the quadrilateral on each tiered platform comprises a color that is different than the color along the at least one of the vertical side wall and the horizontal side wall of the tiered platforms on the first side of the quadrilateral.

8. The tiered beverage pong game system of claim 1, wherein the beverage container placement marker of the top tiered platform comprises a color that is different than a color of the beverage container placement markers on any other tiered platform.

9. The tiered beverage pong game system of claim 4, wherein on a first side of the quadrilateral of the lowest tiered platform, a leftmost beverage container marker comprises a first color, two middle beverage container markers comprise a second color, and a rightmost beverage container marker comprises a third color.

10. The tiered beverage pong game system of claim 9, wherein on the first side of the quadrilateral of the second lowest tiered platform, a leftmost beverage container marker comprises the first color, a middle beverage container marker comprises the second color, and a rightmost beverage container marker comprises the third color.

11. The tiered beverage pong game system of claim 10, wherein on the first side of the quadrilateral of the third lowest tiered platform, a leftmost beverage container marker comprises the first color and a rightmost beverage container marker comprises the third color.

12. The tiered beverage pong game system of claim 1, wherein the plurality of tiered platforms is coupled to a flotation device.

13. The tiered beverage pong game system of claim 1, wherein the plurality of tiered platforms is configured to collapse within a center of a lowest tiered platform.

14. A method of using a tiered beverage pong game system comprising:

a) bouncing, by a first player, a ball on a surface such that the ball lands in a beverage container that is located on an interchangeable beverage container placement marker located on a tiered platform of the tiered beverage pong game system comprised of a plurality of tiered platforms each having a quadrilateral shape and at least one of a width and a length that is greater than any higher tiered platform, wherein each side of each tiered platform comprises a different color along at least one of a vertical side wall and a horizontal side wall of the tiered platform that corresponds with a color among the plurality of colors of the beverage container placement markers and a player among the a plurality of players and wherein each beverage container placement marker comprises a disk having a raised lip around an edge of the beverage container placement marker that is configured to prevent movement of the beverage container placed thereon;

b) passing the beverage container to a second player from among the plurality of players, the second player determined based on a color of the beverage container placement marker on which the beverage container into which the ball landed is located;

c) consuming, by the second player, a beverage within the beverage container and removing the beverage container from the tiered platform; and repeating steps a through c by each player in turn until one player clears a single beverage container located on a single beverage container marker on a top tiered platform and all beverage containers from the one player's side of the tiered platforms having the color along the at least one of the vertical side wall and the horizontal side wall of the tiered platforms associated with the one player.

15. The method of claim 14, wherein the first player passes the beverage container to the second player when the first player bounces the ball into a beverage container located on a side of the tiered platform associated with the first player.

16. The method of claim 14, further comprising consuming, by the first player, a beverage within a beverage container into which the ball lands when the beverage container is located on a side of the tiered platform associated with another player.

17. The method of claim 14, further comprising determining which player has a first turn by bouncing a ball by each player and awarding the first turn to the player whose ball landed within a beverage container on a tiered platform higher than that of any other player.

18. The method of claim 14, wherein the beverage pong game system comprises four quadrilateral tiered platforms and a lowest tiered platform comprises sixteen beverage container markers, a second lowest tiered platform comprises twelve beverage container markers, and a third lowest tiered platform comprises eight beverage container markers.

* * * * *